United States Patent [19]

Maeshima

[11] Patent Number: 4,615,630

[45] Date of Patent: Oct. 7, 1986

[54] PAPER FEEDING CONTROL APPARATUS

[75] Inventor: Mikio Maeshima, Kasugai, Japan

[73] Assignee: Hitachi, Ltd., Tokyo, Japan

[21] Appl. No.: 682,083

[22] Filed: Dec. 17, 1984

[30] Foreign Application Priority Data

Dec. 21, 1983 [JP] Japan ..... 58-239711

[51] Int. Cl.[4] ..... B41J 11/51

[52] U.S. Cl. ..... 400/608.3; 400/608.4; 400/596; 400/600.3; 400/608.2; 226/108

[58] Field of Search ..... 400/586, 592, 595, 596, 400/599, 600.3, 608.3, 608.2, 608.4, 605, 606, 607, 607.2; 226/108

[56] References Cited

U.S. PATENT DOCUMENTS

| | | | |
|---|---|---|---|
| 1,638,138 | 8/1927 | Baskerville | 400/586 |
| 1,820,258 | 8/1931 | Vickers | 400/586 |
| 2,840,217 | 6/1958 | Nelson et al. | 226/74 |
| 2,858,926 | 11/1958 | Metzner | 400/554 |
| 3,028,944 | 4/1962 | Taperell | 400/608.4 |
| 3,966,037 | 6/1976 | Zambolin | 400/608.1 |
| 4,074,797 | 2/1978 | Lewis et al. | 400/608.4 |
| 4,109,779 | 8/1978 | Bauer | 400/608.4 |
| 4,205,770 | 6/1980 | Wojdyla | 400/608.1 |
| 4,229,113 | 10/1980 | Anderson et al. | 400/596 |
| 4,234,261 | 11/1980 | Hendrischk et al. | 400/608.3 |
| 4,403,878 | 9/1983 | Hosogaya | 400/608.4 |

FOREIGN PATENT DOCUMENTS

| | | | |
|---|---|---|---|
| 187282 | 11/1982 | Japan | 400/605 |
| 145487 | 8/1983 | Japan | 400/586 |
| 14978 | 1/1984 | Japan | 400/608.3 |

OTHER PUBLICATIONS

Hamilton, "Stencil Card Holder", IBM Technical Disclosure Bulletin, vol. 1, No. 5, p. 3, 2/59.

*Primary Examiner*—William Pieprz
*Attorney, Agent, or Firm*—Beall Law Offices

[57] ABSTRACT

An impact printer having a roll platen on which a continuous paper is set and fed by the rotation of the roll platen rotated by a first motor, and a cut sheet is fed on the continuous paper by a feeding mechanism which includes feed rollers rotated by a second motor. When information is printed on the cut sheet, a controller drives a second motor and a first motor so as to feed the cut sheet and the continuous paper in the same direction. Since the continuous paper is fed synchronously when feeding the cut sheet during printing on the cut sheet, print elements impact on different positions of the continuous paper and the roll platen. Accordingly, impact traces on specific areas of the continuous forms and wearing of specific areas of the platen are prevented.

37 Claims, 6 Drawing Figures

PAPER FEEDING CONTROL APPARATUS

BACKGROUND OF THE INVENTION

The present invention relates to a paper feeding control apparatus and, more particularly, to a paper feeding control apparatus which deals with two kinds of paper in an impact type printer.

The impact type printer, for example, a wire matrix type serial printer is used as an output device of a computer system. The impact type printer usually has a platen on which papers feed and set.

Today, users request printers for a variety of purposes such as printing on cut sheets, for instance individual sheets such as A4, letter size sheets, or on continuous papers, and on multiple sheets connected together in definite length and separated by perforated tear lines, or on both kinds of paper. When dealing with both kinds of paper, the continuous papers should be fed and set on the platen, when information is printed. On the other hand, when there is a need to print on cut sheets after continuous paper printing, the continuous papers have to be taken from the platen to change to cut sheets which are also fed on to the platen. This change of paper performed by an operator is sometimes troublesome. An impact type printer which eliminates this trouble is desired.

SUMMARY OF THE INVENTION

The applicant invented a wire matrix type printer on which cut sheets were fed with the continuous papers, such as continuous forms, still on the platen when information was printed on the cut sheet by the wire element's impact. The cut sheets were fed line by line on top of the stationary continuous forms.

But in the above case, since the continuous forms were still kept on the platen and not removed while information was printed on the cut sheet, the same line of the continuous forms was also impacted although the cut sheet was fed line by line. Accordingly, an imprint was left on one line of the continuous form. In addition, since impact occurred on only one part of the platen, that part of the platen became worn.

An object of the present invention is to provide a paper feeding control apparatus which prevents imprints on specific parts of a first paper when information is printed on a second paper fed on top of the first and from wearing a specific area of a platen in an impact type printer.

The first paper, for instance a continuous paper, is usually set on a roll platen, and fed forward and backward by a first feeding mechanism such as the rotation of the platen which is actuated by a first motor. In order to independently feed the second paper, for instance cut sheets, forward and backward on the first paper, there is arranged a second feeding mechanism separate from the first feeding mechanism, which includes feed rollers rotated by a second motor.

According to the present invention, when information is printed on the second paper, the first paper is fed by a predetermined amount and the platen is rotated to avoid repeated impact on specific parts of the first paper and the platen.

There is provided a controller such as a microprocessor to control the rotation and the direction of rotation for the first and the second motors. When information is printed on the second paper, the first paper is fed by a predetermined amount under the control of the controller which controls and rotates the first motor, in correspondence with feeding of the second paper. Printing elements impact not only on the second paper to print character patterns but also on different areas on the first paper and the platen.

Accordingly, because the first paper is also fed in correspondence with the second paper feed, no imprint is left on the same part of the first paper, and undue wear is avoided at a specific area of the platen.

The first paper is fed backwards after printing on the second paper is finished. In order to designate the amount of backward rotation of the first motor, there is provided a memory such as a counter to store the number of forward rotations by the second motor until the printing of the second paper is finished.

The controller rotates the first motor backwards according to the information stored in the memory. Then the first paper returns to its initial position.

Accordingly, another object of the present invention is to provide a paper feeding control apparatus which eliminates waste of the first paper.

FIGS. *2a, 2b* and *2c* are side elevational views of paper being fed by the platen and the rollers.

Figure 3:
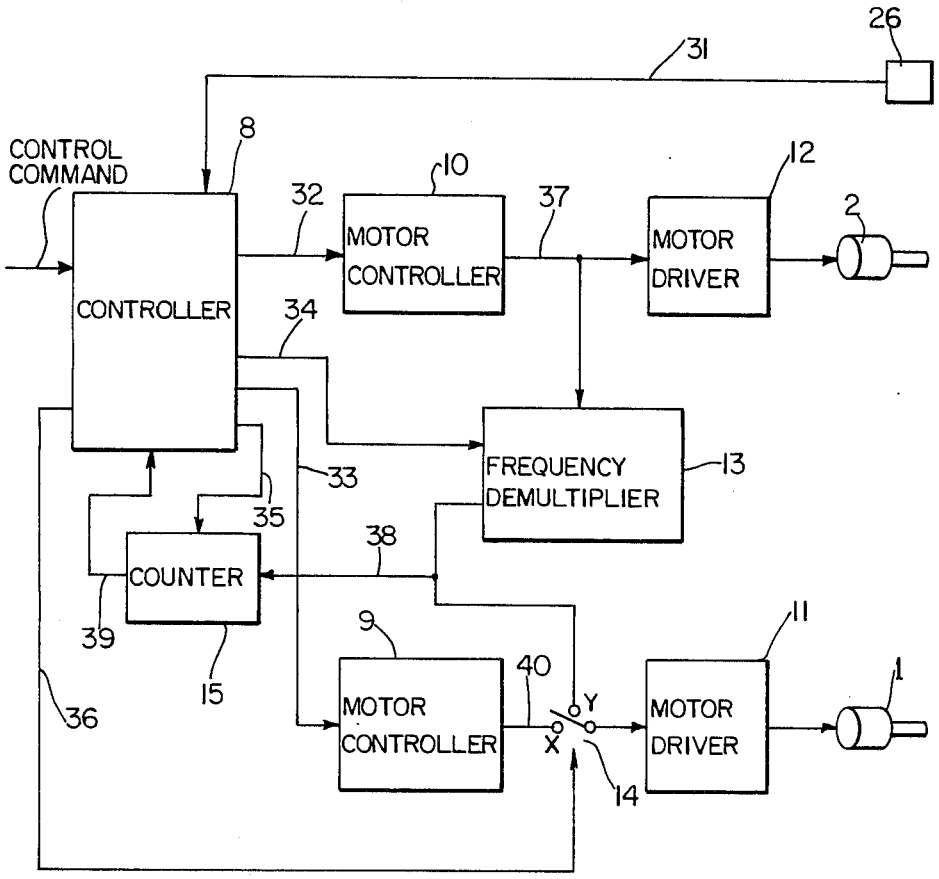

FIG. 3 is a block diagram of a paper feeding control apparatus of the present invention.

Figure 4:
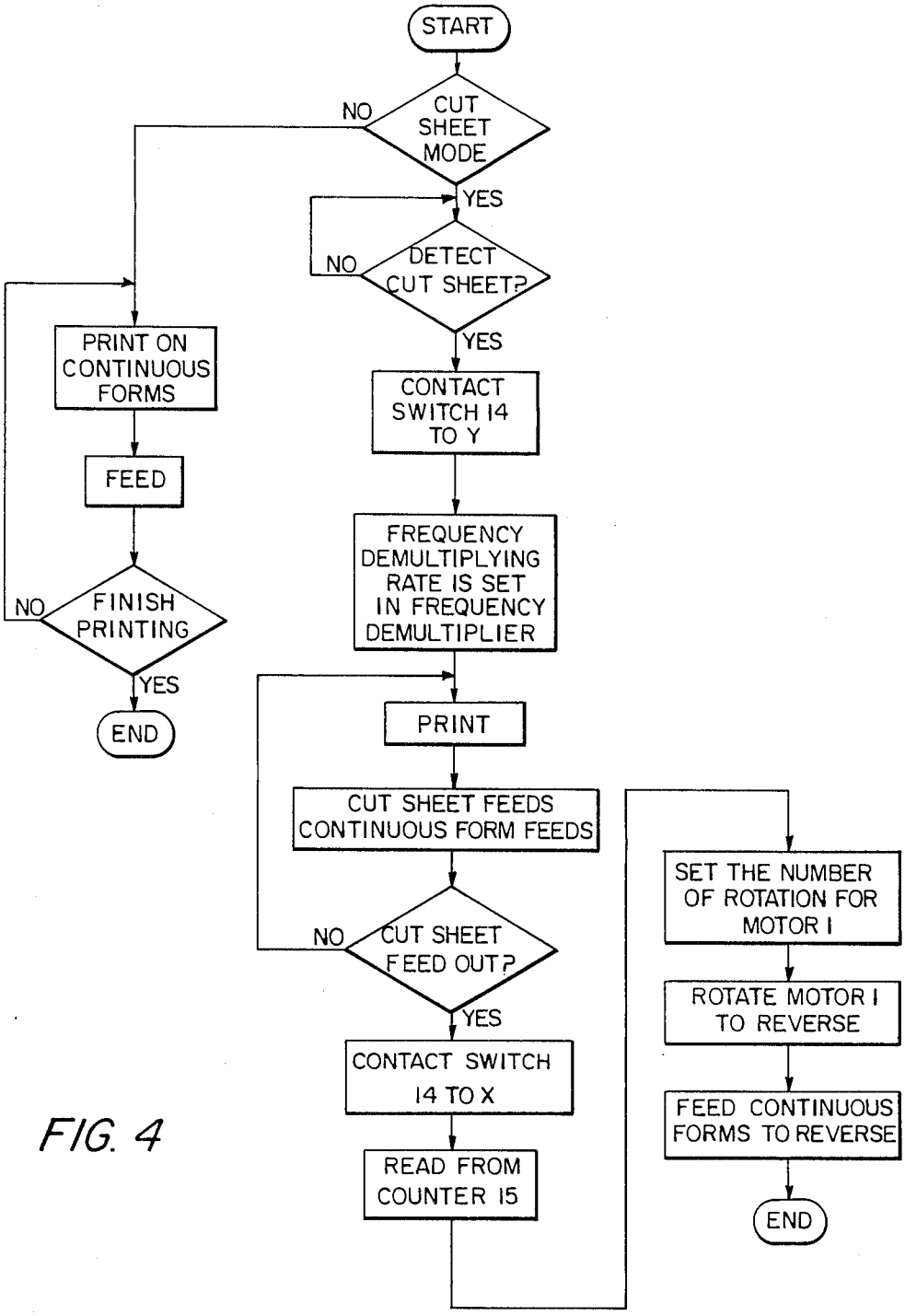

FIG. 4 is a partial flowchart for controlling the paper feeding.

DESCRIPTION OF THE PREFERRED EMBODIMENT

Figure 1:
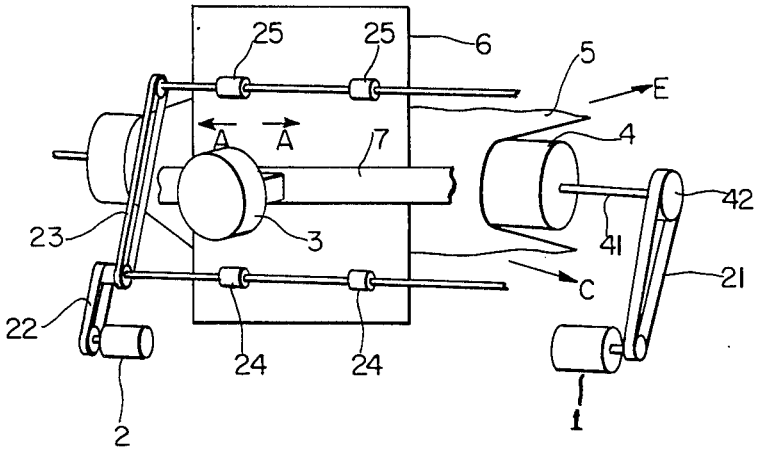
FIG. 1 is a perspective view of the serial printer having a wire matrix printing head.
Figure 2A:
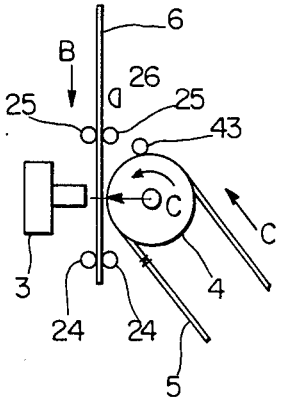

FIG. 1 shows a sketched perspective view of a serial printer having a wire matrix printing head 3. A wire matrix printing head 3 in which a plurality of wires are arranged, is supported by rails (not shown) and moved along the direction of arrows A by a driving mechanism (not shown). A roller platen 4 is arranged in parallel with the movement direction of the printing head 3. A pulley 42 is fixed to an axle 41 of the roller platen 4. A belt 21 is hung between the pulley 42 and the axle of rotation of a motor 1. As the motor 1 can be rotated in a forward direction and a reverse direction, the roller platen 4 can be rotated in the directions shown by an arrow C and an arrow E in FIGS. *2a, 2b* and *2c*. The continuous forms 5 are set on the platen 4 while being pushed by a pressure roll 43 (in FIG. 2) and fed to the direction shown by the arrow C and E. The continuous forms 5 usually have sprockets which are hung on sprocket wheels (not shown). When information is printed on the continuous forms 5, the continuous forms 5 are fed in the direction shown by the arrow C by the rotation of the platen 4 and the driving sprocket wheels line by line while the print head 3 moves in the direction of arrow A and wires of the head 3 impact on the continuous forms 5 through an ink ribbon 7.

In order to feed a cut sheet 6 on the continuous forms 5 set on the platen 4, there is arranged a feeding mechanism as follows. The cut sheet 6 is fed by rollers 25 and rollers 24 in which one side of the rollers 24, 25 are pressure rollers and the another side of the rollers 24, 25 are feed rollers. Belts 22 and 23 are hung around the axles of the feed roller 24, 25 and the axle of the motor 2. The cut sheet 6 is fed along the direction shown by arrows B and D in FIGS. *2a, 2c* by rotation of the motor 2 in both directions. When information is printed on the cut sheet 6, the cut sheet 6 is fed line-by-line on the continuous forms 5.

As above mentioned, the continuous forms 5 and the cut sheet 6 are respectively fed by the motor 1 and the motor 2. According to the present invention, the motors 1 and 2 are controlled particularly as follows:

FIG. 3 shows a block diagram of the paper feeding control apparatus for controlling motors 1 and 2. There is provided a photo sensor 26 located on a route for feeding the cut sheet 6 in order to detect the front and the rear edge of the cut sheet 6 as shown in FIG. 2. A signal 31 detected by the photo sensor 26 is transferred to a controller 8.

Motors 1 and 2 are for example, pulse motors. These motors 1 and 2 are respectively driven in the forward direction and reverse direction by operation of motor drivers 11 and 12. The rotational direction and the number of rotations for the motors 1 and 2 are controlled by signals 37 and 40 from motor controllers 10 and 9, respectively. In order to designate the rotational direction and the number of rotations, the controller 8 generates respectively a signal 32 and 33 to the motor controllers 10 and 9. These signals 32 and 33 are transferred from the controller 8 when a control command is sent to the controller 8.

The pulse motors 1 and 2 are rotated by a predetermined number which feeds papers 5, 6 at the rate of 1/120 inches per one pulse given from the drivers 11, 12. If the continuous forms 5 and the cut sheet 6 are fed by 1/6 ($=1/120\times20$) inches respectively, for instance, the signals 32 and 33, which indicate twenty pulses as the number of increments of rotation, are transferred from the controller 8 to the motor controller 9 and 10 and set therein. The motors 1 and 2 are rotated corresponding to the signals 33 and 32.

A signal 37 out from the motor controller 10 is also transferred to a frequency divider 13 which divides the number of increments of rotation. On the other hand, the controller 8 generates a frequency division rate which is transferred by way of a signal line 34 and set in the frequency divider 13. The rate of frequency division is predetermined and stored in a memory (not shown) in the controller 8.

For example, when the continuous forms 5 are fed by 1/120 inches, a value "1/20" as the rate of frequency division is predetermined and transferred to the frequency divider 13 from the controller 8.

A signal 38 from the frequency divider 13 is transferred to counter 15 and a terminal Y of a switch 14.

The counter 15 is initialized by a clear command sent from the controller 8 via lead 35 and counts the signal 38 from the frequency divider 13. As the result, a totalization will be stored in the counter 15. The total in the counter 15 indicates the number of rotational increments by which the motor 1 has fed the continuous forms 5 synchronously with the feeding of the cut sheet 6.

The switch 14 is switched to contact a terminal X or Y by a switching control command 36 transferred from the controller 8. The switch 14 has a function to switch between one of two modes of feeding either only the continuous forms 5 or the continuous forms 5 and cut sheet 6 together.

The controller 8 detects the signal 31 from the sensor 26. If the sensor 26 detects the bottom edge of the cut sheet 6, the controller 8 will send out the switching control command 36 to connect the switch 14 to terminal Y. The signal 38 from the frequency divider 13 is sent to the motor driver 11. On the other hand, if the sensor 26 does not detect the bottom edge of cut sheet 6, it means that there are no cut sheets in the route, and the controller 8 will send out the control command 36 to connect the switch 14 to terminal X. Then the signal 40 from the motor controller 9 is transferred to the motor driver 11.

Accordingly, when information is being printed on the continuous forms 5, the signals 40 indicating the number of rotational increments and the direction of rotation are transferred from the motor controller 9 to the motor driver 11 to feed the continuous forms 5, for instance, along direction of arrow E shown in FIG. 1 by 1/16 inches. On the other hand, when information is being printed on the cut sheets 6, the frequency demultiplied signal 38 is transferred to the motor driver 11 through terminal Y. As above mentioned, for instance, the motor 2 is controlled so that the cut sheet 6 is fed by 1/6 inches, and the motor 1 is controlled so that the continuous forms 5 are fed by 1/120 inches.

The counter 15 is useful for preventing the continuous forms 5 from being wasted in the present invention. As the continuous forms 5 are fed during feeding of the cut sheet 6 and then are fed again during feeding a next cut sheet 6, the amount of paper 5 which is used becomes wasteful. If the continuous forms are fed 1/120 inches as above mentioned, the amount of paper being wasted is lessened. The controller 8 can designate any value as the rate of frequency division. If the rate "1.0" is designated in the frequency demultiplier 13 by the controller 8, the rate of feeding the cut sheet 6 is equal to the rate of feeding the continuous forms 5. The wastage of continuous forms 5 is greater in this latter case.

The continuous forms 5 are prevented from being wasted as follows. The cut sheet 6 is fed out along the arrow D in FIG. 2c after finishing printing. When the sensor 26 detects the bottom edge of the cut sheet 6, the controller 8 receives the detection signal 31 from the sensor 26 and recognizes that the cut sheet 6 has already fed out from the route. Then, the controller 8 gets the content of the counter 15 by way of the signal 39, and transfers the signal 36 to contact the switch 14 to terminal X and transfers the signal 33 to the motor controller 9 to rotate the motor 1 in the reverse direction according to the content of the counter 15 which has stored the total of the signal from the frequency demultiplier 13. According to this control of motor 1, the continuous forms 5 are returned to their initial position when printing begins on the cut sheet 6.

Next the operation will be explained by referring to a flowchart in FIG. 4. The continuous forms 5 are previously set on the platen 4. In this state, the sensor 26 always detects whether the cut sheet 6 is present or not on the route. A host computer (not shown) transmits print information and an added control command to distinguish between the printing paper 5 and 6. The print information is given to the printing head 3 and the control command is given to the controller 8.

The controller 8 interprets the control command and determines whether the control command indicates the continuous printing mode for printing on the continuous forms 5, or the cut sheet printing mode for printing on the cut sheet 6. As the result, if operation is in the continuous printing mode, the controller 8 transfers the command to switch 14 to connect the terminal X and operates the motor controller 9. The printing head 3 moves along the direction of arrow A to print information on continuous forms 5. With synchronization of the rotation of the motor 1 by the motor driver 11, the continuous forms 5 are fed along the arrow C by one line. Each time after feeding one line, a determination is made about whether the printing is finished completely. If not, printing and feeding are repeated such as above mentioned until printing is finished.

The cut sheet printing mode according to the present invnetion is described below.

When the controller 8 recognizes the cut sheet printing mode as the result of the interpretation of the control command transferred from a host computer, the controller 8 checks whether the sensor 26 detects the cut sheet 6. When the cut sheet 6 is fed into the route on this mode, the sensor 26 soon detects the edge of the cut sheet 6. Then, the controller 8 transfers the command to connect the switch 14 to the terminal Y through the signal line 36 and the rate of frequency division, for instance, "1/20" as above mentioned, to set in the frequency divider 13 through the signal line 34. Additionally, the counter 15 is initialized by the signal 35 from the controller 8.

In this state, the printing head 3 moves along the arrow A to print information on the cut sheet 6. After printing one line, the cut sheet 6 and the continuous forms 5 are fed with the predetermined amount. For instance, the cut sheet 6 is fed along the arrow B (in FIG. 2*a*) by 1/6 inches according to the rotation of the motor 2 controlled by the motor controller 10 and the motor driver 12 and the continuous forms 5 are fed along the arrow C (in FIG. 2*a*) by 1/120 inches equal to "1/6" and the rate "1/20".

Next, the existence of the cut sheet 6 is checked by the sensor 26. When the cut sheet 6 is present in the route and information remains to be printed, the remaining information is printed on the cut sheet 6. The cut sheet 6 and the continuous forms 5 are fed repeatedly as above mentioned. On the other hand the counter 15 adds the rate of frequency division through the signal 38 in order and stores the latest totalized value.

Figure 2B:
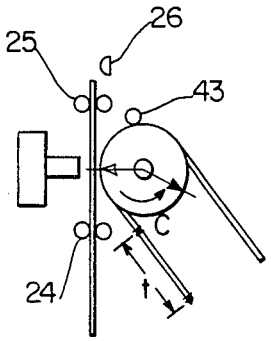
Figure 2C:
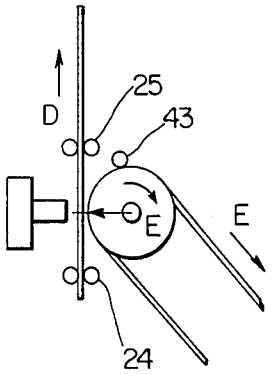

When the printing on the cut sheet 6 is finished, the continuous forms 5 have been fed along the arrow C by the length "t" (in FIG. 2*b*). Next, the operation moves to feeding the cut sheet 6 out. If the cut sheet 6 is fed out along the arrow D shown in FIG. 2*c* and the controller 8 recognizes that the sensor 26 detects the bottom edge of the sheet 6, the controller 8 sends the command to connect the switch 14 to the terminal X and reads the counter 15 through the signal line 39. Then the content of the counter 15 and the command for determining the direction of the motor rotation are set in the motor controller 9 by way of the signal line 33 from the controller 8. Accordingly, the platen 4 is rotated by the motor 1 along the arrow E and the continuous forms 5 are fed by the length "t" and returned to the initial state.

Since the continuous forms 5 are fed as above mentioned, it is understood that the platen 4 and the continuous forms 5 are not impacted on their same parts by the printing elements and wear and imprints are prevented on the same parts of the platen and the continuous forms 5. Additionally since the continuous forms 5 are returned to their initial state from which the printing was begun, they are not wasted.

Although a certain embodiment of the present invention has been described, various changes and modifications can be made in the present invention. For instance, the number of the motor rotations and the rate of frequency division are variable values not limited to the above embodiment. If the rate of frequency division is designated as "1.0", for instance, the feeding number for the continuous forms 5 is the same as the one for the cut sheet 6. Accordingly, the frequency divider 13 is not necessary in this situation.

As another modification, since control of the continuous forms and the cut sheet are independent of each other, controlling the continuous forms 5 to return backward does not depend on the detection for the bottom edge of the cut sheet 6 by the sensor 26. Returning can be done at any time after printing on the cut sheet.

In another modification, continuous papers can be fed by a predetermined amount when printing finishes several lines of a cut sheet or one or a plurality of cut sheets.

In addition, continuous papers can be fed forward in advance by a predetermined amount synchronized with feeding of the cut sheet. In these case information is printed on the cut sheet when the cut sheet is fed out on the route shown in FIG. 2*c*.

The present invention can be adapted to not only the serial type printers but also other impact type printers.

Necessary changes to effectuate the modifications can be accomplished by altering the programming for the controller.

I claim:

1. A paper feeding control apparatus in a printer, comprising:

(a) a platen on which first paper is set;

(b) a printing means facing said platen for printing information;

(c) first means for feeding the first paper toward a predetermined direction when information is printed by the printing means on the first paper, and for feeding the first paper toward a reverse direction; and (d) second means separate from said first feeding means for independently feeding second paper partially contacting the first paper on said platen toward a predetermined direction, wherein said second feeding means feeds the second paper and said first feeding means feeds the first paper by a predetermined amount synchronously with the feeding of the second paper toward same direction when information is printed on the second paper by the printing means and said first means feeds the first paper in the reverse direction when information is not being printed.

2. The paper feeding control apparatus according to claim 1, wherein said first means includes a first feeding mechanism to feed a continuous paper as the first paper and said second means includes a second feeding mechanism to feed a cut sheet as the second paper.

3. The paper feeding control apparatus according to claim 2, further comprising:

control means for automatically enabling only said first feeding mechanism when information is printed on the continuous paper and automatically enabling said first and second feeding mechanism synchronously when information is printed on the cut sheet.

4. A paper feeding control apparatus in a printer, comprising:

(a) a platen;

(b) printing means facing said platen for printing information;

(c) first means for providing motive power to said platen for feeding a first paper toward a predetermined direction while the first paper is at least partially contacting the surface of said platen and for feeding the first paper toward a reverse direction when information is not being printed;

(d) second means separate from said first means for feeding a second paper independently of the motive power for feeding the first paper, toward a predetermined direction between the first paper and said printing means;

(e) first actuating means for causing said first feeding means to feed the first paper;

(f) second actuating means independent from and unconnected to said first actuating means for causing said second feeding means to feed the second paper; and (g) control means for automatically designating feeding modes which include a first mode to feed the first paper and a second mode to feed the first paper and the second paper, and enabling said first actuating means in the first mode, and enabling both said first actuating means and said second actuating means synchronously with one another in the second mode, whereby said printing means is able to print information on said first paper during said first mode and to print information on said second paper during said second mode.

5. The paper feeding control apparatus according to claim 4, wherein said first means includes a first feeding mechanism to feed a continuous paper as the first paper and said second means includes a second feeding mechanism to feed a cut sheet as the second paper.

6. The paper feeding control apparatus according to claim 4, further comprising:

means for sensing the presence of the second paper in a feeding route during the second mode, wherein said control means enables said first and second actuating means according to a signal transferred from said sensing means in response to the presence of the second paper.

7. The paper feeding control apparatus according to claim 4, wherein said first means includes a first motor and said second means includes a second motor different from said first motor.

8. The paper feeding control apparatus according to claim 7, further comprising:

means for maintaining a rotation ratio during the second mode between the first motor and the second motor so that the first motor rotates slower than the second motor in the second mode.

9. The paper feeding control apparatus according to claim 4, further comprising:

memory means for storing a value proportional to the feeding of the first paper until the printing on the second paper is finished, wherein said control means drives said first actuating means so as to feed the first paper in the reverse direction by the value stored in said memory means after the printing on the second paper is finished.

10. A paper feeding control apparatus in a printer, comprising:

(a) a roll platen;

(b) printing means facing said roll platen for printing information;

(c) means for rotating said roll platen toward a predetermined direction while a first paper at least partially contacts the surface of said roll platen and thereby feeds the first paper and for rotating said roll platen toward a reverse direction;

(d) means separate from said platen and rotating means for feeding a second paper independently of said rotating means toward a predetermined direction between the first paper and said printing means;

(e) first actuating means for actuating said rotating means;

(f) second actuating means separate from and unconnected to said first actuating means for actuating said feeding means independently of said first actuating means; and (g) control means for automatically designating feeding modes which include a first mode with said printing means able to print information on the first paper, and a second mode with said printing means able to impact on the first and the second paper while printing information on the second paper, driving said first actuating means during the first mode and synchronously driving both said first actuating means and said second actuating means during the second mode, and driving said first actuating means when information is not being printed and thereby actuating said rotating means to rotate said roll platen in the reverse direction.

11. The paper feeding control apparatus according to claim 10, further comprising:

means for sensing the presence of the second paper in a feeding route during the second mode, wherein said control means enables said first and second actuating means according to a signal transferred from said sensing means in response to the presence of the second paper.

12. The paper feeding control apparatus according to claim 10, wherein said first means includes a first motor and said second means includes a second motor different from the first motor.

13. The paper feeding control apparatus according to claim 8, further comprising:

means for maintaining a rotation ratio during the second mode between the first motor and the second motor so that the first motor rotates slower than the second motor during the second mode.

14. The paper feeding control apparatus according to claim 10, further comprising:

memory means for storing a value proportional to the feeding of the first paper until printing on the second paper is finished, wherein said control means drives said first actuating means to feed the first paper backward by the value stored in said memory means after printing on the second paper is finished.

15. A method for feeding paper in a printer, comprising:

setting a first paper on a platen;

feeding the first paper toward a forward direction by subjecting the platen to rotation when printing information on the first paper;

feeding separately a second paper partially contacting the first paper on the platen, and feeding the first paper towards the same direction when printing information on the second paper, with the second paper being fed independently of the step of subjecting the platen to rotation; and feeding the first paper in a reverse direction when not printing information on the second paper.

16. The method according to claim 15, further comprised of feeding a continuous paper as the first paper, and feeding a cut sheet as the second paper.

17. The method according to claim 15, wherein said second feeding step feeds the second paper faster than said first feeding step feeds the first paper when printing information on the second paper.

18. The method according to claim 15, wherein said second feeding step feeds the second paper and the first paper so that the amount of feeding of the second paper is greater than the amount of feeding of the first paper during the printing on the second paper.

19. The method according to claim 15, further comprising:

actuating the rotation of the platen on which a printing head impacts to provide for feeding of the first paper when printing information on either the first paper and the second paper.

20. The method according to claim 15, further comprising:

automatically interpreting a control command which indicates a first printing mode to print information on the first paper and a second printing mode to print information on the second paper; and automatically inplementing one of the printing modes for said first feeding and second feeding according to interpretation of the control command.

21. The method according to claim 16, further comprising:

detecting the presence of a cut sheet at the platen; and feeding the continuous paper and the cut paper synchronously in response to the presence of the cut sheet at the platen.

22. The method according to claim 15, further comprising:

feeding the first paper in the reverse direction after printing on the second paper is finished.

23. The method according to claim 15, further comprising:

storing a a value proportional to the feeding of the first paper occurring during printing on the second paper; and feeding the first paper in the reverse direction according to the value stored.

24. The method according to claim 23, wherein said storing step stores the value in a counter which successively counts signals generated synchronously with forward feeding of the first paper.

25. The method according to claim 15, wherein said feeding steps feeds the first paper by the rotation of a first motor and feeds the second paper by the rotation of a second motor; and further comprising maintaining a rotation ratio between the first and second motor so that the first motor rotates slower than the second motor when printing information on the second paper.

26. A paper feeding method in an impact type printer, comprising:

interpreting a control command with information to be printed to identify one of a plurality of printing modes including first and second printing modes indicated by the control command;

using a rotation ratio between first and second motors so that the first motor rotates slower than the second motor during the second printing mode;

rotating the first motor in a predetermined direction to feed a first paper during the first printing mode;

detecting the presence of the second paper during the second printing mode;

rotating the second motor in a predetermined direction to feed the second paper and simultaneously rotating the first motor in the same direction independently of the second motor to feed the first paper at a speed slower than the second paper during the presence of the second paper in the second printing mode;

making a successive count of the rotation of the first motor during the second printing mode; and rotating the first motor backwards according to the count to feed the first paper backward after the printing on the second paper is finished.

27. A paper feeding control apparatus in a printer, comprising:

a platen on which first paper is set, means for mounting said platen, and means for maintaining the paper against said platen;

printing means facing said platen for printing information;

first means for providing motive power to said platen for feeding the first paper toward a predetermined direction when information is printed on the first paper by said printing means; and for providing motive power to said platen for feeding the first paper toward a reverse direction; and second means separate from said first means for providing motive power independently from the provision of motive power for feeding the first paper, for feeding second paper partially contacting the first paper on said platen toward a predetermined direction, wherein said second feeding means feeds the second paper and said first feeding means feeds the first paper by a predetermined amount synchronously with the feeding of the second paper toward the same direction when information is printed on the second paper by the printing means, and said first means provides motive power to said platen for feeding the first paper in the reverse direction when information is not being printed.

28. The paper feeding control apparatus according to claim 27, wherein said first means includes a first feeding mechanism to feed continuous paper as the first paper and said second means includes a second feeding mechanism to feed a cut sheet as the second paper.

29. The paper feeding control apparatus according to claim 28, further comprising:

control means for driving only said first feeding mechanism when information is printed on the continuous paper and driving said first and second feeding mechanisms synchronously when information is printed on the cut sheet.

30. The paper feeding control apparatus according to claim 27, further comprising:

means for maintaining a rotation ratio during the second mode between the first means and the second means so that the first means rotates slower than the second means during the second mode.

31. A paper feeding control apparatus in a printer, comprising:

a platen on which first paper is set, means for mounting said platen, and means for maintaining the paper against said platen;

printing means facing said platen for printing information;

first means for providing motive power to said platen for feeding the first paper toward a predetermined direction when information is printed on the first paper by said printing means and for providing motive power to said platen for feeding the first paper toward a reverse direction; and second means separate from said first means for providing motive power independently from the provision of motive power for feeding the first paper, for feeding second paper partially contacting the first paper on said platen toward a predetermined direction in correspondence with the first paper; and control means for enabling said first means in a first mode to cause said first means to advance the first paper, for enabling both said first means and second means in a second mode to respectively advance said first paper and said second paper synchronously in the same direction, and for enabling said first means when information is not being printed on said second paper to cause said first means to feed the first paper in the reverse direction.

32. The paper feeding control apparatus according to claim 31, further comprising:

means for sensing the presence of the second paper in a feeding route during the second mode, wherein said control means enables said first and second means according to a signal transferred from said sensing means in response to the presence of the second paper.

33. The paper feeding control apparatus according to claim 31, wherein said first means includes a first motor and said second means includes a second motor different from the first motor, further comprising:

means for maintaining a rotation ratio during the second mode between the first motor and the second motor so that the first motor rotates slower than the second motor during the second mode.

34. The paper feeding control apparatus according to claim 31, further comprising:

memory means for storing a value proportional to the feeding of the first paper until printing on the second paper is finished, wherein said control means enables said first means to feed the first paper backward by the value stored in said memory means after printing on the second paper is finished.

35. A paper feeding control apparatus in a printer, comprising:

control means for interpreting a control command with information to be printed to identify one of a plurality of printing modes including the first and second printing modes indicated by the control command;

first and second motors;

means for establishing a rotation ratio between said first and second motors whereby the first motor rotates slower than the second motor during the second printing mode;

first means responsive to said control means for actuating the first motor to rotate in a predetermined direction to feed a first paper during the first and second printing modes, and for actuating the first motor to feed the first paper in a reverse direction;

second means responsive to said control means for actuating the second motor to rotate in a predetermined direction to feed the second paper simultaneously with the rotation of the first motor during the second printing mode, said first actuating means being responsive to the rotation ratio to feed the first paper at a speed slower than the second paper during the second printing mode; and means for indicating the rotation of the first motor during the second printing mode;

whereby after printing on the second paper, said first actuating means enables the first motor to feed the first paper in the reverse direction according to the indication.

36. The paper feeding control apparatus according to claim 35, further comprising:

means for sensing the presence of the second paper in a feeding route during the second mode, wherein said control means enables said first and second actuating means according to a signal provided by said sensing means in response to the presence of the second paper.

37. The paper feeding control apparatus according to claim 36, wherein said control means drives only said first actuating means to enable said first motor when information is printed on the first paper and drives both said first and second actuating means to synchronously enable both said first and second motors when information is printed on the second paper.

* * * * *